United States Patent [19]

Székács

[11] Patent Number: 4,651,261

[45] Date of Patent: Mar. 17, 1987

[54] PAR LAMP

[75] Inventor: György Székács, Budapest, Hungary

[73] Assignee: Tungsram Rt., Budapest, Hungary

[21] Appl. No.: 773,143

[22] Filed: Sep. 6, 1985

[30] Foreign Application Priority Data

Sep. 21, 1984 [HU] Hungary ..... 3571/84

[51] Int. Cl.[4] ..... F21V 7/00

[52] U.S. Cl. ..... 362/309; 362/310; 362/348; 362/336

[58] Field of Search ..... 362/341, 255, 297, 310, 362/308, 347, 348, 309, 336, 338, 329

[56] References Cited

U.S. PATENT DOCUMENTS

| | | | |
|---|---|---|---|
| 1,918,087 | 7/1933 | Donley | 362/341 |
| 2,260,736 | 10/1941 | Benton | 362/338 |
| 3,309,554 | 3/1967 | Corenzo | 362/308 |
| 4,209,825 | 6/1980 | Shackelford | 362/308 |
| 4,484,254 | 11/1984 | Puckett et al. | 362/328 |

*Primary Examiner*—E. Rollins Cross
*Attorney, Agent, or Firm*—Gabriel P. Katona

[57] ABSTRACT

The invention relates to a headlamp, the envelope of which is constituted internally by concave reflecting surfaces but at least by one concave reflecting surface having the shape of a paraboloid of rotation, further, in the focus of said paraboloid-shape reflecting surface a light-emitting element is accommodated with its center line being perpendicular to the axis of the reflecting surface, further, having said envelope shut up with a transparent cover plate, the surface of which is uniformly roughened, and/or on said surface uniformly distributed, geometrically regular beam-forming optical elememts are provided. Essential feature of the invention consists of having over the cover plate (1) also irregularly-shaped oblong beam-forming optical elements, the longitudinal axes of which are parallel with the center line (10) of the light-emitting element (2). Said oblong beam-forming optical elements are expediently cylindrical lenses (5, 6, 7, 8) or prisms.

4 Claims, 2 Drawing Figures

PAR LAMP

Figure 1:
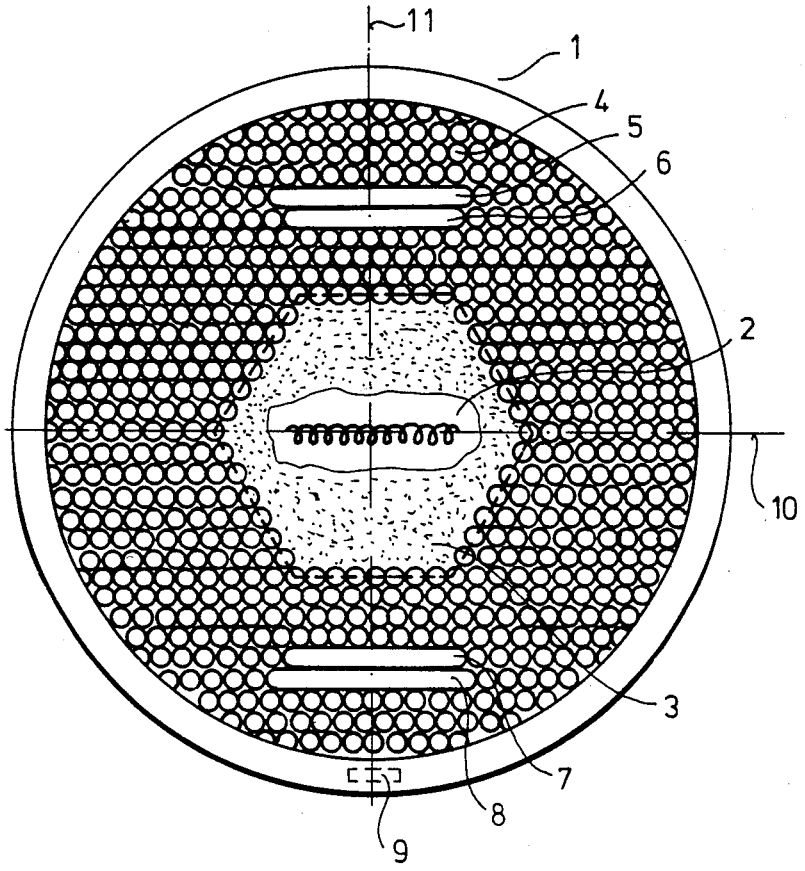

The invention relates to a headlamp, the envelope of which is constituted internally by one or more concave reflecting surfaces wherein at least one concave reflecting surface having the shape of a paraboloid of rotation, further, in the focus of said paraboloid-shape reflecting surface a light-emitting element is accommodated with its centre line perpendicular to the axis of the reflecting surface, further, the envelope is shut up with a front cover plate made of some transparent material, on the surface of which uniformly distributed, geometrically regular, beam-forming optical elements are provided.

The arrangement according to the invention may be employed advantageously in the so-called PAR (parabolic aluminium reflector) lamps, which are headlamps provided with a pressed hard glass envelope and with a reflecting surface having the shape of a paraboloid of rotation, where the lamp and lamp body constitute a common unit. As it is known, the front face of the envelope of such a headlamp is shut up with a patterned front glass (lense). The pattern on the front serves for shaping the light beam. The pattern may be a uniform roughening of the surface, or it may consist of a multiple of regular-shape, larger-size (of mm magnitude), beam-forming elements uniformly distributed over the surface. By regular-shaped optical elements, in the sense of the present description, solid bodies formed over the surface of the front glass are understood, these solids having their base on the surface of said front glass, and sections of the optical elements taken parallel with their base are geometrically regular planes or circles. (It should be noted that in our definition, as first approximation, some neglection has been made by assuming the front glass as being a plane, owing to the small size of the optical elements and the relatively large radius of curvature of the front glass.) Uniformly arranged regular optical elements do not modify the asymmetry of an asymmetrical light beam, therefore, when looking back from any point of the front glass facing the paraboloid-shape reflecting surface, the incandescent coiled filament is seen as a thin line, and this characteristic feature manifests itself, as an "inherited" property, in the asymmetry of the light beam after having passed through the front glass. Due to the uniform distribution of said large number of small optical elements,—e.g. lenses—over the surface of the front glass, the distribution of light varies when viewed in different planes.

In recent years, as a result of effors aimed at saving energy, several measures have been introduced by manufacturers to increase the efficiency of PAR lamps. Such an improvement consists of replacing conventional coiled filaments by halogen lamps. Aimed at reducing light losses is a measure proposed at the 1983 conference of IES (Illuminating Engineering Society, USA) consisting of mounting the helical filament axially with, instead of perpendicularly to, the axis of rotation of the headlamp, to eliminate light beam asymmetry resulting from the oblong shape of filament. However, mounting the filament perpendicularly to the axis of rotation of the headlamp is more favourable technologically than arranging it axially.

The present invention is intended to improve the efficiency of headlamps provided with light-emitting elements fitted perpendicularly to the geometrical axis of rotation of the lamps, by means of correcting the light-beam asymmetry caused by the oblong shape of the light-emitting element.

Said correction is achieved in our invention by providing on the front glass a number of oblong-shape, beam-forming optical elements with their longitudinal axis arranged parallel with the longitudinal axis of the light-emitting element, e.g. of that of the coiled filament.

Correspondingly, present invention relates to a headlamp, the envelope of which is constituted internally by concave reflecting surfaces, but by at least one concave reflecting surface having the shape of a paraboloid of rotation, further, having in the focus of said paraboloid-shaped reflecting surface a light-emitting surface with its centre line arranged perpendicularly to the axis of said reflecting surface, further, said envelope being shut up by a transparent glass cover plate, the surface of which is uniformly roughened, and/or over this surface uniformly distributed, geometrically regular beam-forming optical elements are provided, and over said cover plate there are also irregularly-shaped oblong beam-forming optical elements arranged with their longitudinal axes parallel to the longitudinal axis of the light-emitting element.

The simplest and most advantageous way of providing said oblong beam-forming optical elements is to form them from the material of the glass front plate itself, as indentations and/or protrusions.

Such an oblong beam-forming optical element may be e.g. a cylindrical lense or a prism.

So, by the method according to the invention, the light asymmetry resulting from the light-emitting element being mounted perpendicularly to the axis of the headlamp, can be corrected, offering the possibility of improving the efficiency.

In the following, the invention will be described with reference to an embodiment of a headlamp shown by way of example in the attached drawing. In the drawing FIG. 1 shows a front elevation of a lamp embodiment in accordance with the invention.

Figure 2:
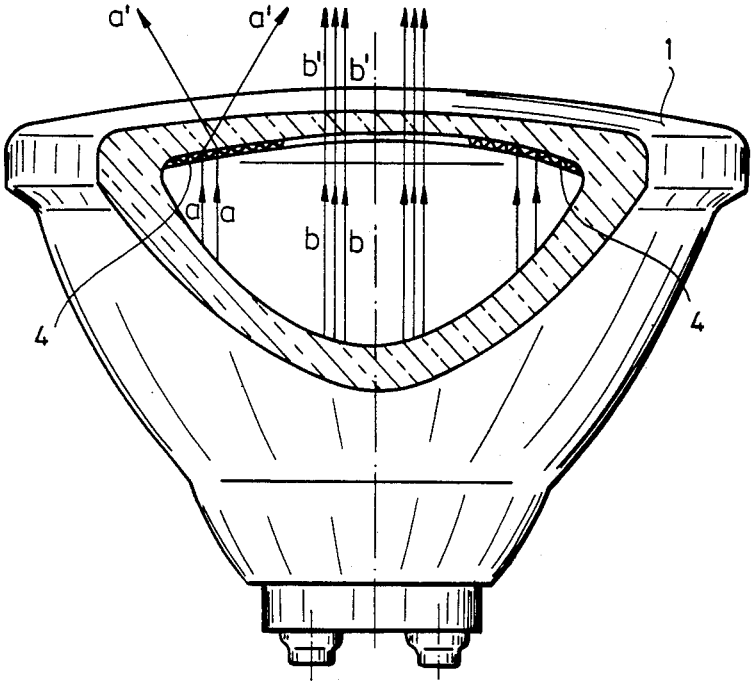

FIG. 2 shows a side view of the lamp embodiment of FIG. 1, with a section along the centerline of the element 8 being shown broken out.

The spherical-shaped cover plate shown in FIG. 1 is made of hard glass by pressing. Its diameter is about 122 mm, its thickness is about 4 mm, and its radius of curvature is 254 mm. Over the concave surface of cover plate 1 a pattern has been formed in the course of pressing. In the central part of the cover plate 1 a uniformly roughened portion 3 having the shape of a regular hexagon of 27 mm side length is provided. Over the remaining portion of the surface of the glass cover plate a pattern made up of rows of tiny lenticular optical elements 4 are formed, the individual optical elements being arranged closely beside each other, protruding from the surface by max. 1 mm, and each element having a diameter of 3.7 mm. In the drawing the location of the light-emitting element is also shown. The light beam radiated by the helically wound light-emitting element 2 of about 27 mm length and about 1 mm outer diameter, mounted perpendicularly to the axis of the headlamp, is symmetrically formed by the regular and uniformly distributed elements of the pattern described above, consequently the projected beam of light rays would be asymmetrical. To correct this effect, in the fifth and sixth row of lenses counted from the projection of the centre line 10 of the light-emitting element 2 and on either side of it, cylindrical lenses 5, 6, 7, 8 arranged symmetrically with respect to the centre line 11 of the glass cover plate 1 and having lengths equal to the added-up size of respectively eight and nine optical elements 4 are provided, also protruding by max. 1 mm from the surface. Since the pattern provided on the glass cover plate 1 has to be matched to the position of the light-emitting element 2, to ensure proper alignment, locating nose 9 is provided.

Within the broken out portion of FIG. 2 light rays "a" are shown refracted by elements 4 into divergent light rays "a'" which are passing in various directions and at an rays "b" pass through the cylindrical lens 8 without a change of lateral direction, but with a directional change at various angles to the plane of the drawing.

The above example represents only one variant from among the many possible arrangements, therefore it is necessary to select empirically the optimum design for each different shape of helical wires and glass cover plates to determine the required size, quantity and arrangement of abnormally shaped, oblong beam-forming optical elements fitted parallel to the light-emitting element.

I claim:

1. A PAR lamp, comprising an envelope having a paraboloidal concave reflecting surface, an elongated light emitter having a centerline, said elongated light emitter being disposed focally within said paraboloidal reflecting surface, the centerline of said elongated light emitter being perpendicular to the axis of said reflecting surface, a front cover of a transparent material sealed to said envelope, said front cover having on its surface (i) uniformly distributed, geometrically regular beam-forming optical elements, and (ii) irregularly shaped, elongated beam-forming optical elements, each having centerlines, said centerlines of said elongated beam-forming elements being disposed parallel to the centerline of said elongated light emitter.

2. A PAR lamp according to claim 1, wherein said beam-forming optical elements are molded into said front cover as indentations and/or protrusions.

3. A PAR lamp according to claim 1, wherein said elongated beam-forming optical elements are cylindrical lenses.

4. A PAR lamp according to claim 1, wherein said elongated beam-forming optical elements are prisms.

* * * * *